US006328860B1

(12) United States Patent
Romine et al.

(10) Patent No.: US 6,328,860 B1
(45) Date of Patent: Dec. 11, 2001

(54) DIAPHRAGM CELL CATHODE BUSBAR STRUCTURE

(75) Inventors: Richard L. Romine, Concord; Thomas F. Florkiewicz, Chagrin Falls; John J. Jahn, Painesville; Gerald R. Pohto, Mentor, all of OH (US)

(73) Assignee: Eltech Systems Corporation, Chardon, OH (US)

( * ) Notice: Subject to any disclaimer, the term of this patent is extended or adjusted under 35 U.S.C. 154(b) by 0 days.

(21) Appl. No.: 09/358,927

(22) Filed: Jul. 23, 1999

Related U.S. Application Data

(60) Provisional application No. 60/094,594, filed on Jul. 30, 1998.

(51) Int. Cl.[7] ..... C25B 9/00
(52) U.S. Cl. ..... 204/242; 204/252; 204/279
(58) Field of Search ..... 204/242, 252, 204/243.1, 279

(56) References Cited

U.S. PATENT DOCUMENTS 4,178,225 12/1979 Ruthel et al. .
5,137,612 * 8/1992 Romine et al. ..... 207/279
5,306,410 4/1994 Farmer .
6,045,668 4/2000 Fort et al. .
6,093,442 7/2000 Fort et al. .

FOREIGN PATENT DOCUMENTS 0 466 156 7/1991 (EP) .
0 899 360 8/1998 (EP) .

OTHER PUBLICATIONS

Manufacture Specifications of the Diaphragm cell with Metal Anodes, Sep. 1985, Author unknown.

* cited by examiner

*Primary Examiner*—Kathryn Gorgos
*Assistant Examiner*—Wesley A. Nicolas
(74) *Attorney, Agent, or Firm*—Michele M. Tyrpak; Hudak & Shunk Co., LPA

(57) ABSTRACT

An electrolytic cell comprising a walled enclosure including a cathode sidewall has busbar structure external to the cell. The busbar structure can include a gird bar releasably secured at the sidewall. It also may include a small cathode busbar member on the sidewall. The small busbar member is typically located above and adjacent to the gird bar. there can be internal support members for the cathodes directly secured to the inside face of the cathode sidewall. Furthermore, intercell connection may be handled directly to the outside face of the cathode sidewall. The overall structure can provide reduced potential for sidewall stress corrosion cracking, reduced cathode manufacturing cost, and accommodation of stress relief for the cathode weldment.

15 Claims, 4 Drawing Sheets

DIAPHRAGM CELL CATHODE BUSBAR STRUCTURE

CROSS-REFERENCE TO RELATED APPLICATION

This application claims the benefit of U.S. Provisional Application No. 60/094,594, filed Jul. 30, 1998.

BACKGROUND OF THE INVENTION

1. Field of Invention

The invention relates to electrolytic cells, particularly high amperage diaphragm electrolytic cells. The cells, typically chlor-alkali diaphragm cells, may operate at current capacities of upwards of about 200,000 amperes.

2. Description of the Related Art

It has been known to construct such cells where cathode outer sidewalls, made of electrically conductive material, are encircled with buss structure. For example, there has been shown in U.S. Pat. No. 3,390,072, a high amperage electrolytic cell wherein the sidewall is connected to a source of electrical current through an encircling bar-type bus member, sometimes referred to as a gird bar.

There has thereafter been developed busbar assemblies for diaphragm-type electrolytic cells wherein busbars are connected only to the cathode sidewall and have angled edges. For example, in U.S. Pat. No. 3,783,122, there are shown busbars of triangular shape, which busbars are shorter than the sidewall. Further in the development of angled busbars, several busbar strips, some of which can have triangular-shaped faces, may be utilized. This has been shown in U.S. Pat. No. 3,904,504, wherein it is disclosed to have a cathode busbar structure comprising several busbar strips. The numerous busbar strips, having different relative dimension, are welded to the sidewall.

With regard to fastening busbars to the sidewall, a combination of fastening means may be utilized. Generally, welding can provide for desirable electrical contact between the sidewall and a busbar. However, it is known to bolt a busbar to the sidewall, then weld the busbar at its edges to the sidewall. Bolting can assist in positioning of the busbar on the sidewall, then welding can assure desirable electrical contact as well as assisting in maintaining busbar positioning.

A more recent innovation for providing electrical current to electrolytic cells has improved the gird bar structure for distributing electrical current to the cathode sidewall. Thus as shown in U.S. Pat. No. 4,834,859, a gird bar is provided on a sidewall. In the structure of the innovation of this patent, distributor bars are placed on the inside of the sidewall at the upper and lower regions of the gird bar. These distributor bars conduct electrical current from the sidewall to an exterior face of an inner tube sheet. Cathode tubes are then positioned at the interior face of the tube sheet.

More recently, it has been proposed to provide a wall-sized busbar for the cathode sidewall. Such a structure is shown in U.S. Pat. No. 5,137,612. This patent discloses such a wall-sized busbar and the busbar is interface bonded to the cathode sidewall. The wall-sized busbar can have an extension section for attaching jumper switches.

It would nevertheless be desirable to provide a busbar structure for a cathode sidewall having not only efficient current distribution, but also reduced potential for sidewall stress corrosion cracking. It would also be desirable if such structure could provide reduced cathode manufacturing cost as well as accommodate stress relief characteristic.

SUMMARY OF THE INVENTION

It has now been found possible to provide an efficient cathode sidewall busbar structure having reduced potential for sidewall stress corrosion cracking. The structure of the innovation can further include a cathode sidewall assembly having reduced cathode electrical resistance, i.e., reduced structure drop during electrolytic cell operation. Other features of the present invention pertain to reduced cathode manufacturing cost as well as accommodation of stress relief for the cathode weldment.

In one aspect, the invention relates to an electrolytic cell wherein the cell comprises a walled enclosure providing at least one cathode sidewall for the enclosure and with there being cathode busbar structure external to the cell for conducting electrical current from the cathode sidewall to outside the cell through an outer gird bar extending along an outside face of the cathode sidewall. Within this framework, the invention of this aspect provides the improvement in busbar structure comprising:

- a solid and elongated outer gird bar member releasably secured at the sidewall outside face; and
- a small, solid cathode busbar member situated on the sidewall at least substantially adjacent to said gird bar member, which small busbar member is releasably secured to the sidewall outside face and is directly in contact with the sidewall.

In another aspect, the invention relates to an electrolytic cell wherein the cell comprises a walled enclosure providing at least one cathode sidewall for the enclosure and with there being cathode busbar means external to the cell, including an outer gird bar extending along an outside face of the cathode sidewall, and interior cell structure at an inside face of the cathode sidewall and including cell cathodes incorporating internal support members. Within this framework, the invention of this aspect provides the improvement in such structure comprising:

- a solid and elongated outer gird bar member releasably secured at the sidewall outside face; and
- internal support members supporting the cathodes situated within the electrolytic cell, with the internal support members being directly secured to the sidewall inside face.

A still further aspect of the invention pertains to interconnected electrolytic cells wherein each cell comprises a walled enclosure providing at least one cathode sidewall for said enclosure and electrical intercell connector means are present between adjacent cells, with interior cell structure including cell cathodes incorporating internal cathode support members. In this still further aspect, the improvement in such structure comprises:

- an intercell connector means which is connected directly to an outside face of the cathode sidewall; and
- interior cell structure directly secured to an inside face of the cathode sidewall.

Still other benefits and advantages of the invention will become apparent to those skilled in the art to which it pertains upon a reading and understanding of the following detailed specification.

The invention may take physical form in certain parts and arrangement of parts, a preferred embodiment of which will be described in detail in this specification and illustrated in the accompanying drawings which form a part hereof and herein:

DESCRIPTION OF THE PREFERRED EMBODIMENT

The invention relates generally to electrolytic cells suited for the electrolysis of aqueous alkali metal chloride solutions. The cells may be used for the production of chlorine, chlorates, chlorites, caustic soda, potassium hydroxide, hydrogen and related chemicals. For the sidewall of the cathode-walled enclosure it has been typical to use a conductive metal which has desirable strength and structural properties. Most always, the wall will be made of steel, e.g., cold-rolled, low carbon steel. For the cathode busbar structure the useful metals are those which are highly electrically conductive. Most always this metal will be copper, copper alloy, or copper intermetallic mixture, but there may also be used aluminum.

More particularly, the application of this invention will be to a cell such as a chlor-alkali cell, more often referred to as a diaphragm cell. This cell will have a diaphragm located between anode and cathode electrode members. One or more electrode members may be compressively urged into direct contact with a diaphragm in the cell. The cell will have means for supplying electrical current to the cell, and for directing current from the cathode to a cell gird bar, serving as cell busbar structure. The gird bar will usually be placed at about the midpoint up the vertical height of the cathode sidewall.

Figure 1:
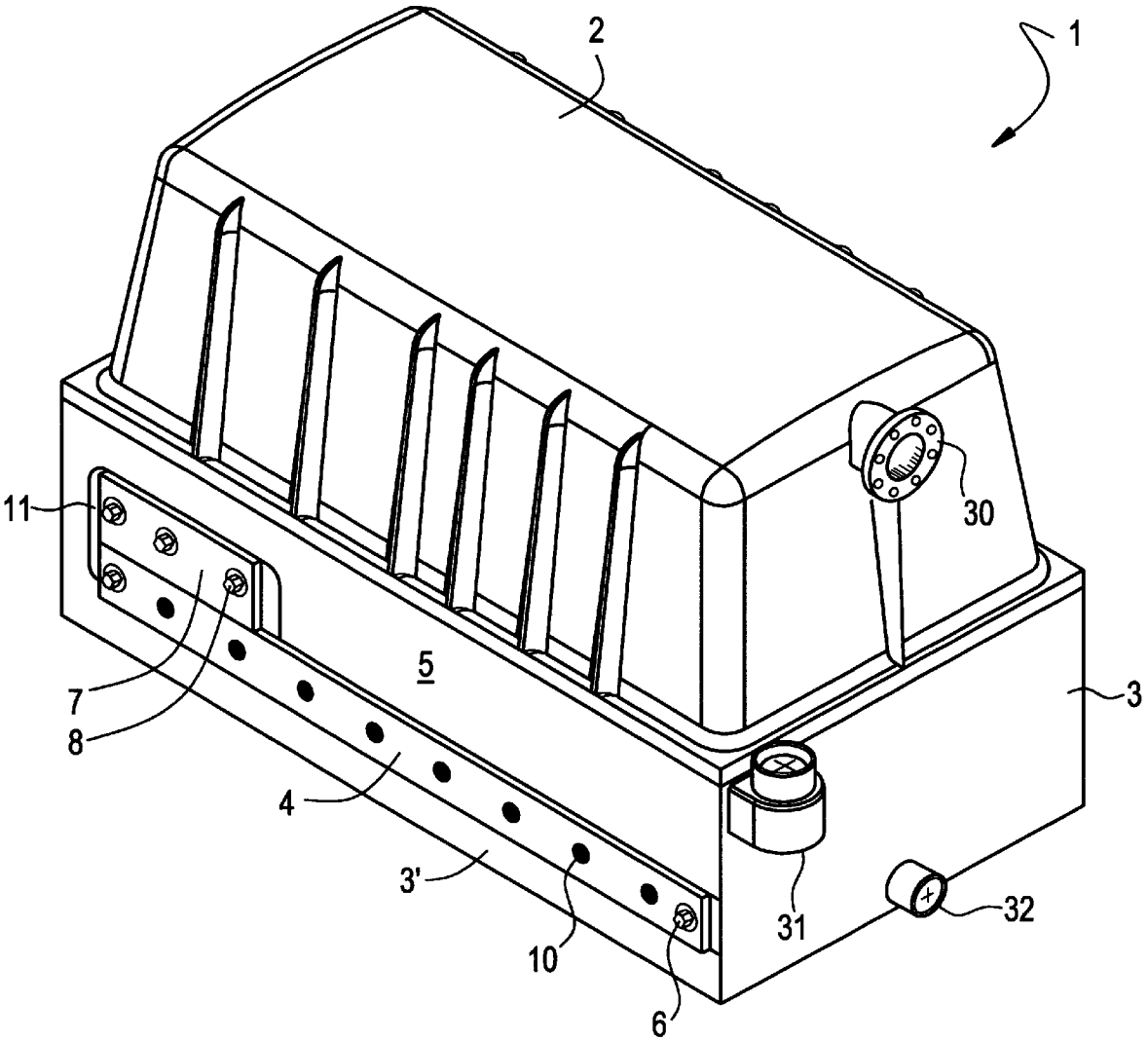
FIG. 1 is a perspective view of a typical electrolytic cell housing showing a representative cathode sidewall of the present invention.

Referring now more particularly to the figures, there is shown a representative structure for the present invention. In FIG. 1, a cell is shown generally at 1, e.g., a chlor-alkali diaphragm cell 1 for producing chlorine and caustic soda. The cell 1 has a cover 2 and four sidewalls, of which two 3, 3' are in view. On the faces of the cathode sidewall 3', positioned upwardly from the bottom of the sidewall 3', a little below the mid-section thereof, is a gird bar 4. The gird bar 4, which is a unitary, rectangular-shaped and elongated gird bar 4, extends horizontally along essentially the complete length of the outer, outside face 5 of the cathode sidewall 3'. The gird bar 4 is releasably secured at the sidewall 3' at the ends of the gird bar 4 by fastener means comprising gird bar end bolts 6. In the middle of the gird bar 4, i.e., between the end bolts 6, there can be used intercell connectors/fastener means comprising bolts 23 (FIG. 2) for securing the gird bar 4 at the cathode sidewall 3'. These bolts 23 are secured through the bolt holes 10 positioned on the gird bar 4 between the end bolts 6. Other than for bolt holes, e.g., the bolt holes 10, the gird bar 4 is generally a solid gird bar 4 and may usually be referred to herein as such. The cell 1 also has a product outlet 30, e.g., a chlorine outlet 30 for a chlor-alkali cell 1, and an upper cell outlet 31, e.g., a hydrogen outlet 31, as well as a lower cell outlet 32, such as for the passage of electrolyte from the cell 1.

At one end of the gird bar 4, and positioned upwardly above the gird bar 4 on the outer face 5 of the cathode sidewall 3', there is positioned a small busbar 7. This small busbar 7 is positioned horizontally along the sidewall outer face 5 and is releasably secured to the face 5 of the cathode sidewall 3' by fastener means comprising busbar bolts 8 for the small busbar 7. Both the gird bar 4 and the small busbar 7 are set within a slight sidewall recess 11. This recess 11 serves to aid in location of the bar 4 and busbar 7. The recess 11 can also provide a prepared, e.g., typically machined, flat surface for enhanced contact for both the gird bar 4 and busbar 7 with the sidewall 3'.

Figure 2:
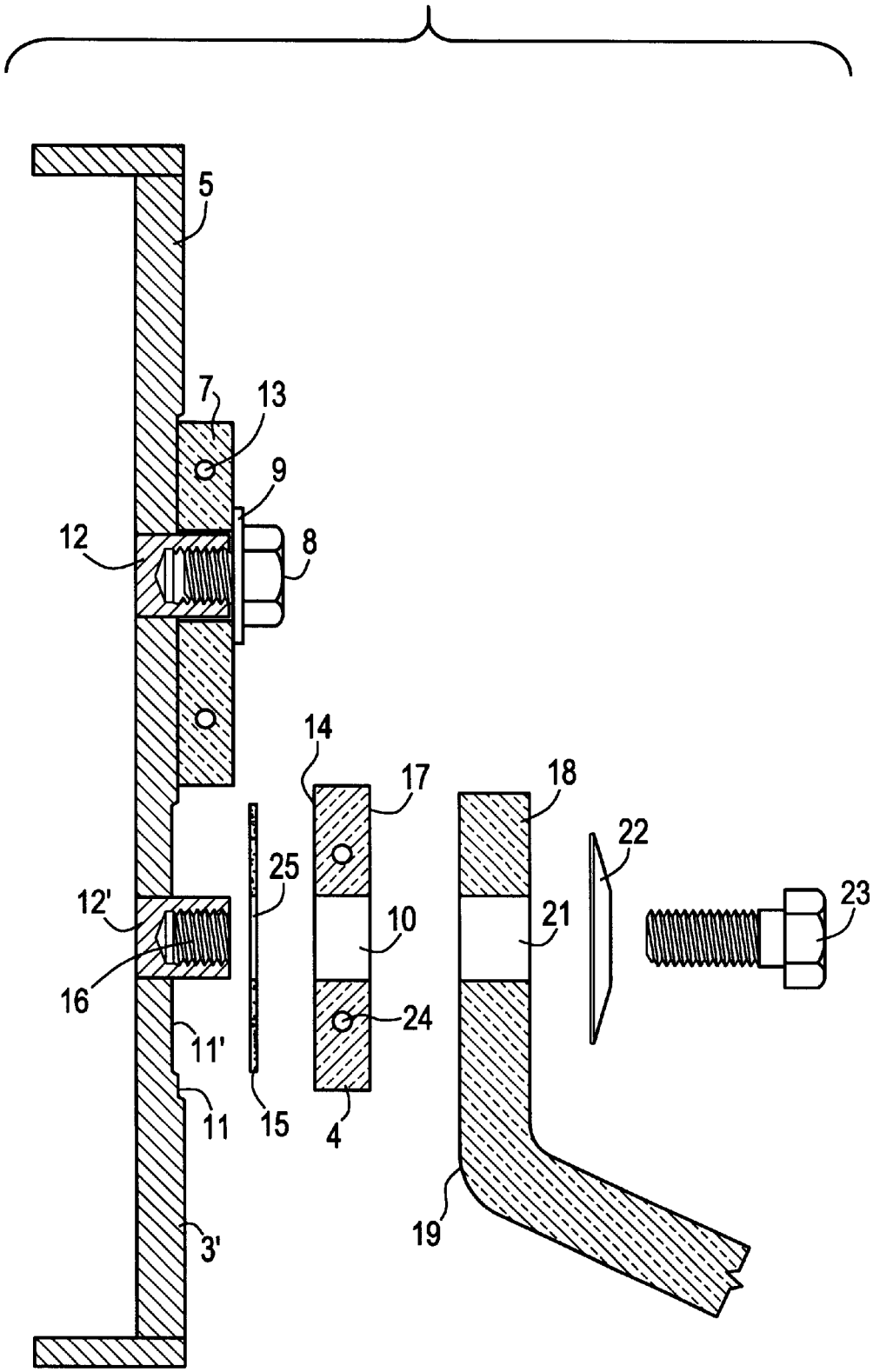
FIG. 2 is a side elevation, partially exploded view in section, of the cathode sidewall for the cell of FIG. 1.

Referring then to FIG. 2, there is shown the representative interface structure of a cathode sidewall 3' with a gird bar 4 and small busbar 7. In this representative structure, the small busbar 7 is situated on the sidewall 3 against the sidewall outer face 5 and within a slight sidewall recess 11. Within the sidewall 3' there is secured an internally threaded small busbar post 12. Threaded into this post 12 is a small busbar bolt 8 and accompanying washer 9. By utilizing this small busbar fastening means of post 12, bolt 8 and washer 9, the small busbar 7 is releasably secured within the slight sidewall recess 11 of the sidewall 3'. Additionally, the small busbar 7 has a cooling passageway 13 to provide for circulation of a cooling fluid through the small busbar 7.

As depicted in FIG. 2, there is positioned below the small busbar 7 a gird bar 4. The gird bar 4 is situated at the sidewall outer face 5 and is positioned at the area of the face 5 having a further sidewall recess 11'. Pressed between the sidewall outer face 5 and the gird bar inner face 14, within the further sidewall recess 11', is a foraminous interface member 15. Secured within the sidewall 3' is a gird bar post 12' having internal threading 16. This post 12' extends through an aperture 25 of the foraminous interface member 15 as well as extending within the bolt hole 10 of the gird bar 4. Additionally, the gird bar 4 has a cooling passageway 24 to provide for the circulation of a cooling fluid through the gird bar 4. By this arrangement of the sidewall outer face 5, interface member 15 and gird bar 4, it will be appreciated that the gird bar 4 is actually secured against the interface member 15, which member is then, in turn, secured against the sidewall outer face 5.

Pressing against the outer face 17 of the gird bar 4 is an intercell connector 18. In assembly, the inner face 19 of the intercell connector 18 will be compressed against the outer face 17 of the gird bar 4. Contained within the intercell connector 18 is an aperture 21 through which an intercell connector bolt 23 passes. The intercell connector bolt 23 and accompanying washer 22 are used to secure the intercell connector 18 by threading the bolt 23 into the internal threading 16 of the gird bar post 12'. This fastener means of post 12', washer 22 and bolt 23 also serve as the gird bar 4 fastening means. The intercell connector 18 then extends away from the sidewall 3 and connects with an adjacent electrolytic cell (not shown).

Figure 3:
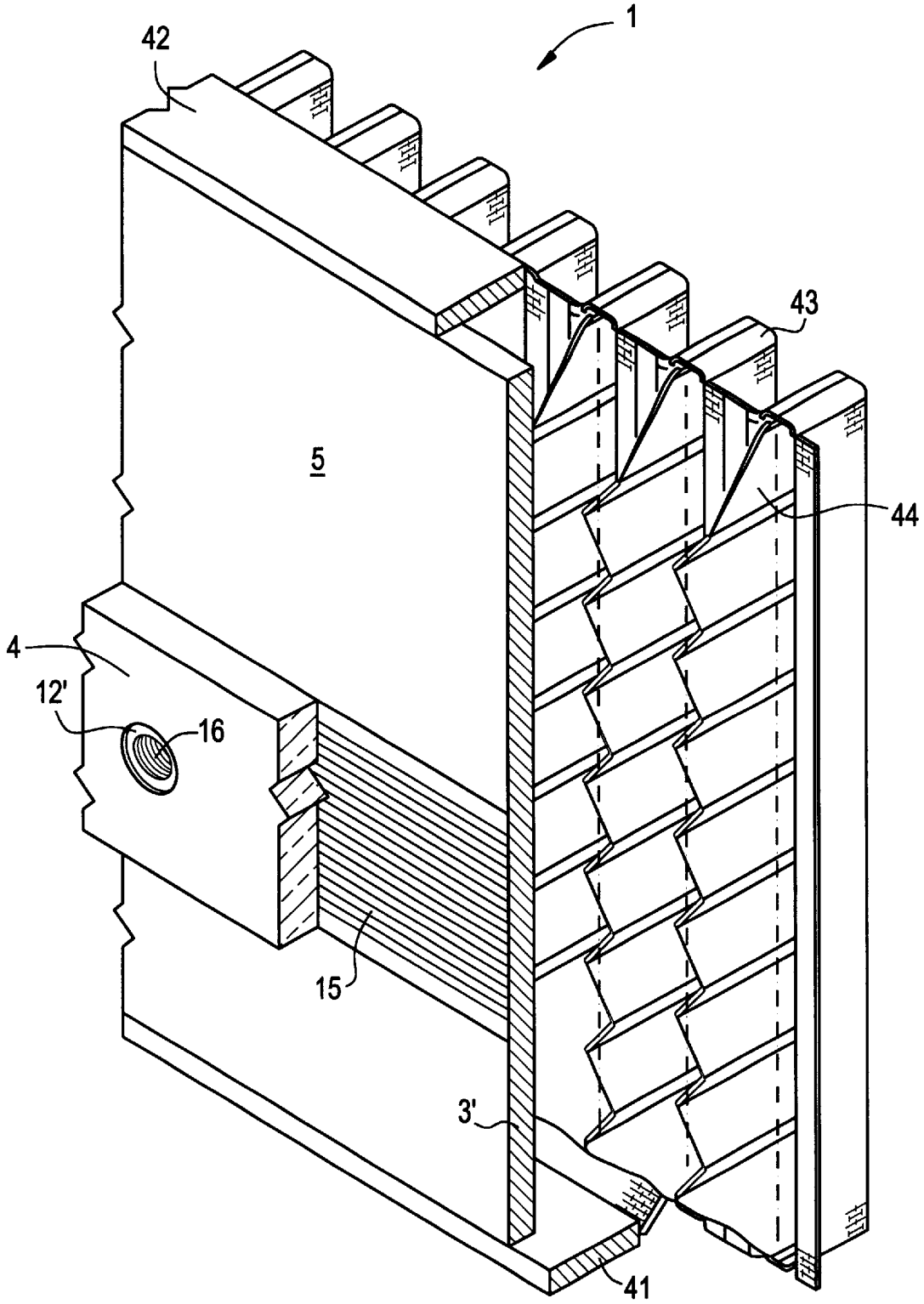
FIG. 3 is a perspective view, partially in cross section, showing a portion of a cathode sidewall, plus cathode tubes and tube supports.

Referring to FIG. 3, the cathode sidewall 3' has a strip of foraminous interface member 15 positioned transversely across the sidewall outer face 5. The foraminous interface member 15 stretches across the cathode sidewall 3' at a position above the bottom of the sidewall 3' and slightly below the mid-point of the sidewall 3'. Pressed against the foraminous interface member 15 is the gird bar 4. The gird bar 4 has been positioned on a gird bar post 12' which has internal threading 16. At the bottom of the cathode sidewal 3', there is a bottom flange 41, and a top flange 42 is positioned at the top of the sidewall 3'.

Within the cell 1 are cathode tubes 43 having internal, corrugated tube supports 44. The tube supports 44 extend against, and are secured to, the inside face of the cathode sidewall 3'. When the cell 1 is prepared for operation, the cathode tubes 43 are covered with a diaphragm (not shown).

Figure 4:
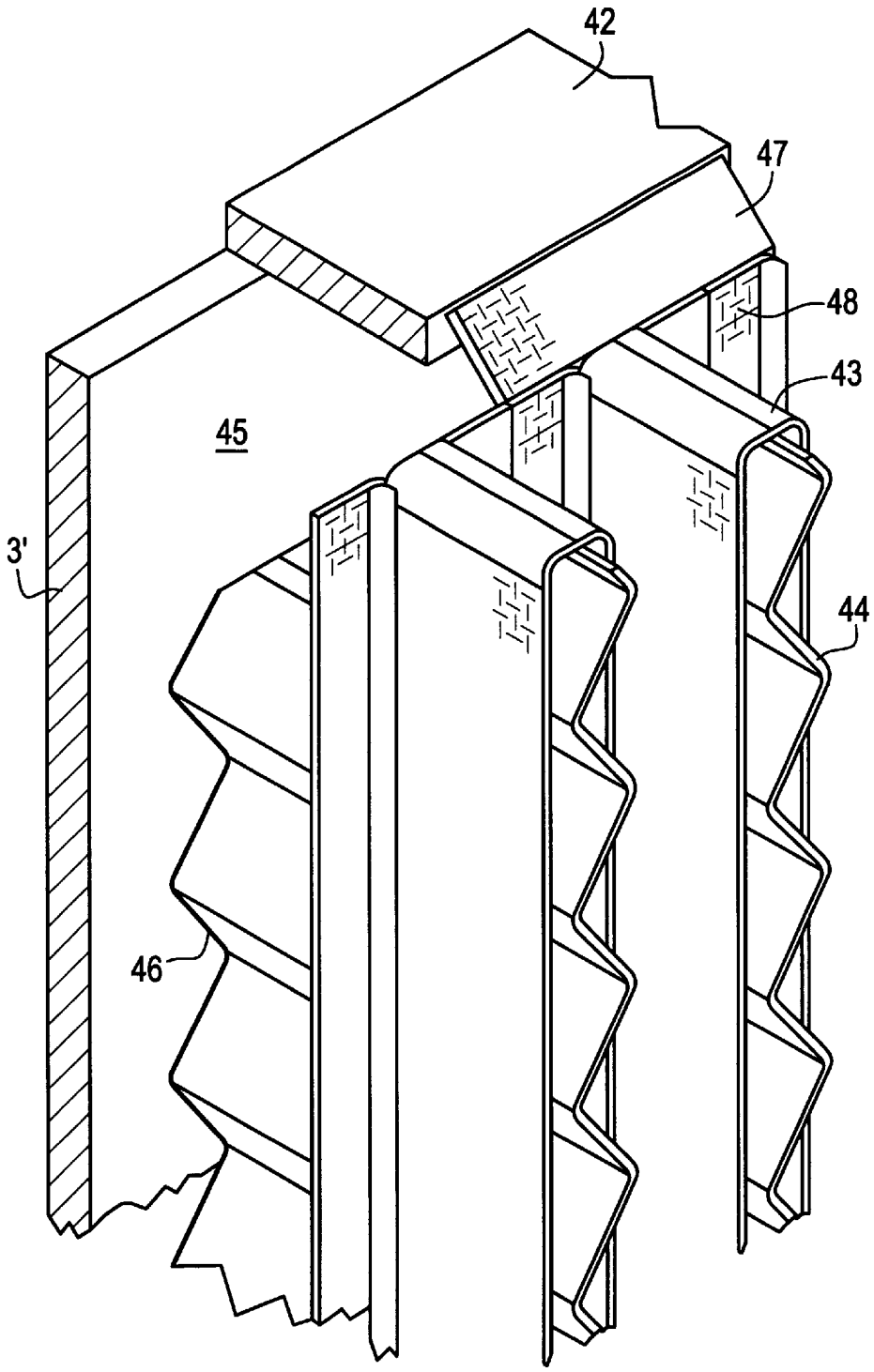
FIG. 4 is a perspective view of elements of FIG. 3 but providing a view toward the inner surface of a cathode sidewall.

Referring, then, to FIG. 4, the cathode sidewall 3' has a top flange 42. Under the flange 42 are corrugated tube supports 44 that support cathode tubes 43. The tube supports 44 are secured to the inside face 45 of the cathode sidewall 3' by welding 46. Extending downwardly from the top flange 42 is a rim screen 47 which depends to a side screen 48, both of which form part of the cathode electrode interface.

As depicted in the figures, the gird bar 4 extends essentially the complete length of the cathode sidewall 3'. It is contemplated that the gird bar 4 could extend along less of the length of the cathode sidewall 3' or could extend the full length of the sidewall 3'. Hence, the sidewall recesses 11, 11' may be less than the length of the inner cathode sidewall 3' or may extend completely across the length of the sidewall 3'. Although the further sidewall recess 11' is preferred to provide an area for the placement of the foraminous interface member 15 on the face 5 of the cathode sidewall 3', it is to be understood that this recess 11' could be eliminated. The slight sidewall recess 11 could also be eliminated not only for the gird bar 4 but also for the small busbar 7. The small busbar 7 may extend in greater length along the side of the cathode sidewall 3' than has been depicted in the figures and can extend completely to an edge of the busbar face 5. Moreover, the small busbar 7 may be positioned below the gird bar 4 or provided in other suitable arrangement with respect to the positioning of the gird bar 4 so long as the small busbar 7 retains its feature of being releasably secured to the cathode sidewall 3'. With regard to the small busbar 7 being positioned "below" the gird bar 4, when the word "below" is used herein rather than the words "along side", and when terms such as "upward", "horizontal" and the like are used herein, they are terms of convenience for referring to the cell of FIG. 1 which is shown in an upright position. These terms are not to be construed as limiting the invention where differing cell configurations might apply.

Although the gird bar 4 and small busbar 7 have been shown to have a rectangular shape in cross section, other shapes are contemplated, e.g., square-shaped in cross section. Although the gird bar 4 need not extend completely along the entire length of the cathode sidewall 3', as has been shown in the figures, it is contemplated that the gird bar 4 will extend at least along a major portion of the sidewall 3' and thus will be an elongated gird bar 4. When reference is made herein to the gird bar 4 and the small busbar 7 as being solid members, it is to be understood that this refers to these members being in a non-perforate form, e.g, they are not in a form such as of an open mesh. However, as described hereinabove, such members may, nevertheless, have bolt holes 10 and cooling passageways 13, 24.

As shown in the figures, the gird bar 4 and small busbar 7 may be releasably secured by bolts 8, 23. When the gird bar 4 is thus secured at the sidewall 3', the interface material 15 may be similarly secured to the sidewall 3'. It will be understood that in using the bolts 8, 23, the counterpart use of posts 12, 12' is preferred although other attendant coupling means are contemplated. Moreover, it is contemplated that the gird bar 4 and busbar 7 may be releasably secured by means other than bolts 8, 23, such as screws, clamps or threaded studs. Where posts 12, 12' are used as fastener means, they are typically affixed within the sidewall 3' by welding to the sidewall 3', as by electrical arc welding. However, other means for securing the posts 12, 12' to the sidewall 3' are contemplated, such as by brazing or soldering. It is also contemplated that the threads 16 could be machined directly into the sidewall 3', as when the thickness of the sidewall 3' is sufficient so that such a feature would not perforate the sidewall 3'. When the threads 16 are so placed in the sidewall 3', the posts 12, 12' can be eliminated.

Before securing the gird bar 4, the sidewall outer face 5, typically on just one or more sidewall recesses 11, 11' at the sidewall outer face 5, may receive a coating, such as of elemental metal, e.g., of nickel, copper or zinc, as a metal plate or cladding, and be referred to herein for convenience as a "plated" metal face 5 or recess 11, 11'. Thus, a steel sidewall 3' might contain a zinc layer such as a galvanized or electrodeposited zinc coating, or have an electroplated silver layer. Although many such coating metals are contemplated, particularly serviceable metals in addition to the nickel, copper, silver and zinc can be cadmium, cobalt and chromium. Alloys may also be useful, e.g., zinc-iron, zinc-aluminum, zinc-cobalt and zinc-nickel. In addition to the above-noted application techniques, the coating may also be applied by deposition procedure such as thermal spraying. Thus, for example, a plasma or flame sprayed copper coating may be applied, as to the sidewall recesses 11, 11'.

For the foraminous interface member 15 there can be used an interface material, which is a deformable conductive material placed between the opposing conductors, known as LOUVERTAC (Trademark). A representative louvered electrical connector of this type has been disclosed in U.S. Pat. No. 4,080,033. This material increases the number of contact points between the gird bar 4 and the cathode sidewall 3', thus ensuring a good distribution of contact points and reducing contact resistance and streamline effect. This conductive material is comprised of a series of spring louvers which give the material the ability to deform and insure contact. The conductive material may be made of a metal such as beryllium copper or aluminum.

Another suitable interface material can be of a compressible gasket material comprised of strips of resilient metal. The metal strips usually have a shallow "V" or "W" profile so as to confer a degree of compressibility to the strip. Adjacent metals strips may be interleaved with a non-metallic material such as a gasket paper, e.g., a graphite sealant material in strip form. Such an interleaved combination, for spiral-wound gaskets, has been disclosed in U.S. Pat. No. 5,161,807. A still further suitable interface material can be a slanted coil spring. Metals for the interface member can include titanium, nickel, nickel alloy, steel including stainless steel, copper and copper alloy, e.g., brass or bronze, and intermetallic mixtures of same.

The gird bar 4 and small busbar are each made from a material of excellent current-carrying capability, e.g., a metal such as copper, copper alloy or copper intermetallic mixture. For good current-carrying characteristic, coupled with desirable resistance to cell environment, the cell cathode sidewall 3' and the top and bottom flanges 42,41 will usually be made of a material such as mild steel. The posts 12, 12' and bolts 8, 23 are generally of a metal such as steel, including stainless steel and high carbon steel. Within the cell, the cathode tubes 43 can be fabricated from a porous steel such as a wire mesh cloth or perforated plate. Cathode tube supports 44 are of copper or the like, e.g., copper alloy. Welding for these supports 44 to the sidewall 3' can be accomplished by welding such as gas metal arc welding. In addition to welding, or along with welding, it is also contemplated that the tube supports 44 may be secured in electrically conductive contact to the sidewall 3' by other means such as brazing or soldering. Although the tube supports 44 have been shown in FIG. 3 as corrugated tube supports 44, it is understood that other shapes, e.g., ribs or plates that may be bowed or have crossbars, are also contemplated.

Particularly where interior cell structure, such as the tube supports 44, are secured to an inside face of the cathode sidewall 3', the intercell connectors 18 may be connected directly to the sidewall outer face 5. By this assembly, the gird bar 4 may be eliminated. It is also contemplated that in such structure the intercell connector 18 connected to the cell 1 without use of a gird bar 4 may be connected to the sidewall outer face 5 through a coating on the outer face 5. Such a coating, e.g., a cladding or plating, as may be useful for this structure are such as have been discussed hereinbefore for application to the side wall outer face 5. With or without such coating, it is also contemplated that where there is no gird bar 4, the intercell connector 18 may connect through a foraminous interface member to the outer face 5 of the cathode sidewall 3'. In such arrangement, the foraminous interface member 15 may be positioned within a sidewall recess 11 and, as mentioned hereinbefore, this recess may have a coating, such as of elemental metal. As an alternative, particularly when interior cell structure is secured to an inside face of the cathode side wall 3', it is contemplated that the gird bar 4 may be connected directly to the sidewall outer face 5. Such connection may be made through a coating on the outer face 5.

The separator within the cell 1 can be a diaphragm which may sometimes be referred to herein as a "diaphragm porous separator". Asbestos is a suitable diaphragm material. For the diaphragm in the cell 1, a synthetic, electrolyte permeable diaphragm can also be utilized. The synthetic diaphragms generally rely on a synthetic polymeric material, such as polyfluoroethylene fiber as disclosed in U.S. Pat. No. 5,606,805 or expanded polytetrafluoroethylene as disclosed in U.S. Pat. No. 5,183,545. Such synthetic diaphragms can contain a water insoluble inorganic particulate, e.g., silicon carbide, or zirconia, as disclosed in U.S. Pat. No. 5,188,712, or talc as taught in U.S. Pat. No. 4,606,805. Of particular interest for the diaphragm is the generally non-asbestos, synthetic fiber diaphragm containing inorganic particulates as disclosed in U.S. Pat. No. 4,853,101. The teachings of this patent are incorporated herein by reference.

Broadly, this diaphragm of particular interest comprises a non-isotropic fibrous mat wherein the fibers of the mat comprise 5–70 weight percent organic halocarbon polymer fiber in adherent combination with about 30–95 weight percent of finely divided inorganic particulates impacted into the fiber during fiber formation. The diaphragm has a weight per unit of surface area of between about 3 to about 12 kilograms per square meter. Preferably, the diaphragm has a weight in the range of about 3–7 kilograms per square meter. A particularly preferred particulate is zirconia. Other metal oxides, i.e., titania, can be used, as well as silicates, such as magnesium silicate and alumina-silicate, aluminates, ceramics, cermet, carbon, and mixtures thereof. Especially for this diaphragm of particular interest, the diaphragm may be compressed, e.g., at a compression of from about one to about 6 tons per square inch.

The invention has been described with reference to preferred embodiment. Obviously, modifications and alterations will occur to others upon a reading and understanding of this specification. It is intended to include all such modifications and alternations in so far as they come within the scope of the appended claims or the equivalence thereof.

Having thus described the invention, it is now claimed:

1. In an electrolytic cell where in the cell comprises a walled enclosure providing at least one cathode sidewall for said enclosure and with there being cathode busbar structure external to said cell for conducting electrical current from the cathode sidewall to outside the cell through an outer gird bar extending along an outside face of said cathode sidewall, the improvement in said busbar structure comprising:

a solid and elongated outer gird bar member secured at said sidewall outside face by fastening means at the ends thereof securing said gird bar member to said sidewall;

a small, solid cathode busbar member situated on said sidewall outside face at least substantially adjacent to said gird bar member, which small busbar member is releasably secured to said sidewall outside face and is directly in contact with said sidewall.

2. The cell of claim 1 wherein said outer gird bar member is a unitary, rectangular-shaped and elongated gird bar member and said gird bar member is positioned upwardly on said cathode sidewall outside face at substantially the mid-section thereof.

3. The cell of claim 2 wherein said rectangular-shaped and elongated gird bar member has fastener means at the middle thereof securing said gird bar member to said sidewall as well as securing intercell connector means to said gird bar.

4. The cell of claim 1 wherein said small busbar member is positioned on said sidewall above said gird bar member, at least substantially at an end of said sidewall, and said small busbar member is directly in contact with said sidewall without an intervening interface member.

5. The cell of claim 1 wherein said small busbar member has at least one internal passageway for the circulation of cooling fluid therethrough.

6. The cell of claim 1 wherein said gird bar member is releasably secured at, and said small busbar member is releasably secured to, said sidewall by fastener means of one or more of bolts, screws, clamps, or threaded studs.

7. The cell of claim 6 wherein said fastener means comprise metal fastener means, said metal of said fastener means is one or more of steel, including stainless steel and high carbon steel, and said fastener means include members affixed within said cathode sidewall.

8. The cell of claim 1 wherein said cathode sidewall is a steel sidewall, and said gird bar member and said small busbar member are each metal members of a metal that is one or more of copper, copper alloy, or copper intermetallic mixture.

9. The cell of claim 1 further comprising a jumper switch connected to said small busbar member.

10. The cell of claim 1 further comprising an electrode member that is compressively urged into direct contact with a diaphragm porous separator in said cell.

11. The cell of claim 1 as a chlor-alkali diaphragm cell for producing chlorine and caustic soda.

12. The cell of claim 1 wherein said interface member contacts said sidewall has a coating of elemental metal.

13. The cell of claim 12 wherein said coating of elemental metals is one or more of a metal strike, a metal flash coating or metal cladding, or a thermally applied metal coating and said elemental metal is one or more of nickel, silver, copper, zinc, and alloys and intermetallic mixtures of same.

14. The cell of claim 1 further comprising interior cell structure at an inside face of said cathode sidewall which includes cell cathodes incorporating internal support member, said internal support members supporting said cathodes and situated within said electrolytic cell, with said internal support members being directly secured to said sidewall inside face.

15. The cell of claim 14 wherein said cathode sidewall is a steel sidewall and said gird bar member and said internal support member are each metal members of a metal that is one or more of copper, copper alloy, or copper intermetallic mixture.

* * * * *